United States Patent [19]

Frischmann et al.

[11] 3,966,156

[45] June 29, 1976

[54] SET OF FIXING ELEMENTS FOR MOUNTING RADIATORS OR LIKE BODIES ON WALLS

[75] Inventors: Albert Frischmann, Freiburg; Kurt Mermi, Emmendingen; Rainer Hermeneit, Freiburg; Rudolf Königer, Buchholz-Batzenhausle, all of Germany

[73] Assignee: Upat-Max Langensiepen KG, Emmendingen, Germany

[22] Filed: May 6, 1974

[21] Appl. No.: 467,275

[30] Foreign Application Priority Data

| | | |
|---|---|---|
| May 7, 1973 | Germany | 7317049[U] |
| May 7, 1973 | Germany | 7317102[U] |
| Sept. 28, 1973 | Germany | 7335061[U] |
| Mar. 11, 1974 | Germany | 2411577 |

[52] U.S. Cl. ..... 248/201; 165/67; 248/232

[51] Int. Cl.[2] ..... F28F 9/26

[58] Field of Search ..... 248/232, 233, 234, 209, 248/201, 295; 165/67

[56] References Cited

UNITED STATES PATENTS

| | | | |
|---|---|---|---|
| 1,172,582 | 2/1916 | Chittenden | 248/234 |
| 2,053,987 | 9/1936 | Farley | 248/234 |
| 2,111,918 | 3/1938 | Moore | 248/232 |
| 3,396,930 | 8/1968 | Gregorovic | 248/232 X |
| 3,833,054 | 9/1974 | Gross | 248/233 |

*Primary Examiner*—J. Franklin Foss
*Attorney, Agent, or Firm*—Michael J. Striker

[57] ABSTRACT

A set of fixing elements for mounting radiators or like bodies on walls comprises a wall fitting, such as a bracket arm of the knock-in or surface-mounting bracket type, associated with a holder for a radiator or like body. The holder is attachable to the wall fitting by a connector in the form of a clip which can be adjustably attached to the wall fitting and clamped in position. The wall fitting is traversed at its freely projecting end by a slot for the reception of part of said clip.

27 Claims, 28 Drawing Figures

SET OF FIXING ELEMENTS FOR MOUNTING RADIATORS OR LIKE BODIES ON WALLS

BACKGROUND OF THE INVENTION

This invention relates to a set of fixing elements for mounting radiators or like bodies on walls, comprising a wall fitting, such as a bracket arm of the knock-in or surface-mounting type, associated with a holder for the radiator or like body.

A conventional arrangement for such purposes comprises, at the free end of a surface-mounting or knock-in type wall fitting, a claw-like holder containing a vertically adjustable screw and adapted to embrace the radiator from above. The usual trough-section end of this holder is bolted to the end of the wall fitting. However, this is an arrangement which still has many shortcomings. Frequently fixation is awkward work because the fixing screw is not readily accessible from the front of the radiator, for example when the radiator itself is to be mounted in a niche. Furthermore, conventional fixing means of the described claw type are of limited adjustability. On the other hand, bracket arms and like wall fittings whether of the surface-mounting or knock-in types cannot always be accurately fixed in the desired position and frequently considerable differences between the resultant position of the holders and the desired position of the radiator must be made good in some way or another. Moreover, from the applicational point of view conventional fixing means for radiators and like bodies and their accessory parts are not very flexible. For instance, the above claw-like holders can usually be attached only to the top and possibly the sides of a radiator, a position in which they are not appropriately located for supporting the weight. They are unsuitable to be applied to the bottom of a radiator because they lack strength and particularly because accessibility is poor during assembly.

SUMMARY OF THE INVENTION

It is therefore an object of the present invention to provide an arrangement for mounting radiators and like bodies on walls in such a way that the above-described shortcomings are avoided and the position of the point of fixation is adjustable and correctable in every direction.

Another object of the invention is to permit the holding and adjusting means to be applied to the bottom of the radiator for supporting its weight, as well as to the top and the sides for locating the same.

Yet another object of the invention consists in providing accessibility to facilitate mounting.

Furthermore, it is a further object of the invention to provide means for insulating the radiator both with respect to heat and noise.

It is also an object of the invention so to design the several elements of the fixing means that they are capable of being combined in several different ways to suit the individual need, and that they are simple and relatively cheap to produce besides being easy to keep in stock and as spares. This applies particularly to the keeping of spares at the site.

Moreover, it is also an object of the invention that the radiator or other installational body should be capable of being firmly suspended between a plurality of fixing means whenever this should be desirable.

To attain these objects the present invention provides a set of fixing elements for mounting radiators or like bodies on walls, which comprises a wall fitting, such as a bracket arm of the knock-in or surface-mounting bracket type, associated with a holder for a radiator or like body, said holder being attachable to the wall fitting by a connector in the form of a clip which can be adjustably attached to the wall fitting and clamped in position, the wall fitting being traversed at its freely projecting end by a slot for the reception of part of said clip.

The holder for supporting or locating the radiator or other body can thus be adjusted and located in relation to the wall fitting, which may be either of the knock-in or surface-mounting bracket arm type. Consequently the position of the holder can be corrected and readjusted even after the radiator has been mounted.

In a preferred embodiment of the invention the clip is a hairpin type U-clip having two substantially parallel slightly resilient shanks, whereas the slot in the freely projecting end of the wall fitting is of a width calculated to guide and locate one of the shanks of the clip, the two shanks being separated by a distance equal to that of the slot from the end face of the wall fitting.

Preferably the inner shank of the clip which is nearest the wall may be provided with a threaded hole for engaging the threads of a clamping screw which passes through a bore in the holder as well as through a plain hole in the outer shank of said clip, the head of the screw being adapted to pull the holder against the outer shank of the clip which is remote from the wall. This arrangement permits the two shanks of the hairpin clip to be pulled together by the screw until the entire clip carrying the holder is tightly wedged on the outer end of the wall fitting in any desired preadjusted position. Moreover, readjustment and relocation can be easily effected from the front of the radiator.

In a further development of the invention the holder may form the movable jaw of a clamp adapted to embrace and grip the edge of the radiator. This permits the radiator to be not merely located, but also tightly clamped and held, if desired. A particularly useful as well as simple design of such a holder is one comprising an upwardly open substantially trough section member which is closed on all sides, the end faces being provided with bearing holes for the clamping screw. Most conveniently the end face of the holder adjacent the head of the screw may be extended to form a gripping member of the clamp. The screw then permits the radiator or other body to be tightly gripped and at the same time adjusted and located with reference to the anchoring wall fitting.

Furthermore the free end of the wall fitting may with advantage be provided on opposite sides with lateral abutments for application thereto of a driving sett, the abutments being separated by a distance which exceeds the width of the hairpin type clip. It is thus possible to preassemble the holder, the clip and a knock-in type wall fitting before applying the driving sett for knocking the wall fitting into the wall. Subsequent assembly where the radiator is actually to be mounted is thus obviated. Moreover, the abutments on the wall fitting may be set further back from the free end of the wall fitting towards the wall than the slot for the clip. The object of this arrangement is to ensure that when knocking the fitting into the wall any deformation will be confined to a region where it cannot have undesirable secondary effects. More particularly that portion of the wall fitting which extends from its end face to the region of the slot for the clip will remain unaffected.

Moreover, according to another feature of the invention, the design of the driving sett may be specially adapted to the design of the holding and adjusting means. The abutments on the wall fitting may with advantage be formed by elongated bulbous enlargements and relatively spaced slightly further apart than corresponds to the width of the clip as well as possibly of the holder. Furthermore, these abutment faces are likewise set back from the end face of the wall fitting slightly more than the slot for the clip. The driving sett is provided with a socket having recesses which conform with this design of the wall fitting, the inside ends of the recesses forming abutment faces which are so located that when the socket end of the driving sett is applied to the wall fitting the bulbous enlargements are received into the recesses before the respective abutment faces cooperate. The result is that the driving sett and the wall fitting will be rotatably coupled and the angular position of the wall fitting and hence of the slot for the clip can thus be easily adjusted and held. In view of the described design of the wall fitting it can be knocked into the wall without the slot and the end face of the fitting being undesirably deformed.

Finally, according to yet another feature of the invention, the wall fitting and its locating slot may be cross sectionally suitably designed in relation to the cross section of a damping member to enable the latter to form the connector between the wall fitting and a radiator or like body, preferably for the purpose of providing thermal and acoustic insulation.

Other features and developments of the invention will be understood as the following particular description with reference to the accompanying drawings proceeds.

However, the following further observations may be appropriate. The features of claim 11 enable a sheet metal holder which is both strong and compact to be inexpensively produced. The features of claim 15 ensure that the holder cannot tilt in relation to the clip. More particularly, if the holder, as claimed in claim 17, is an integral plastics moulding it will not only be cheap to produce but also provide for thermal and sound insulation.

The work of mounting a radiator is facilitated if the head of the clamping screw in the holder is at least partly embraced by the holder itself or some other element to ensure that the blade of a screwdriver applied to the head of the screw cannot slip off sideways. The features claimed in claims 12 and 6 are intended for this purpose. Claim 5 proposes a simple way of strengthening the gripping member of the clamp. Moreover, claims 7 and 8 propose a way of providing a sound and heat insulation in a holder designed to work as a clamp, in a manner similar to that employed in the case of metal parts provided with a push-in type plastics liner. Claim 15 defines features which prevent the hairpin clip from being wrongly inserted into the slot in the end of the wall fitting.

The laterally spaced away sides of the holder in claim 16 permit the holder to be tilted within limits about its longitudinal axis for purposes of adjustment. Although in many instances a non-rotatable connection will be desired, cases do often arise in practice in which the wall fitting and the slot it contains are not in the proper position in relation to the desired position of the radiator. With the above mentioned tiltable disposition of the holder it is more readily possible to adjust to a useful supporting position. For instance, a holder which is tiltable about its longitudinal axis may with advantage be used as the second or last fixing and adjusting means for a radiator or like body and the adjustability which it affords will then ensure that it will take up its share of the load and that it can be well adapted to the contour and desired position of the radiator.

BRIEF DESCRIPTION OF THE DRAWINGS

The accompanying drawings to which reference will be made in the following illustrative particular description exemplify the invention. The drawings are not all drawn to the same scale.

DESCRIPTION OF THE PREFERRED EMBODIMENTS

Figure 1:
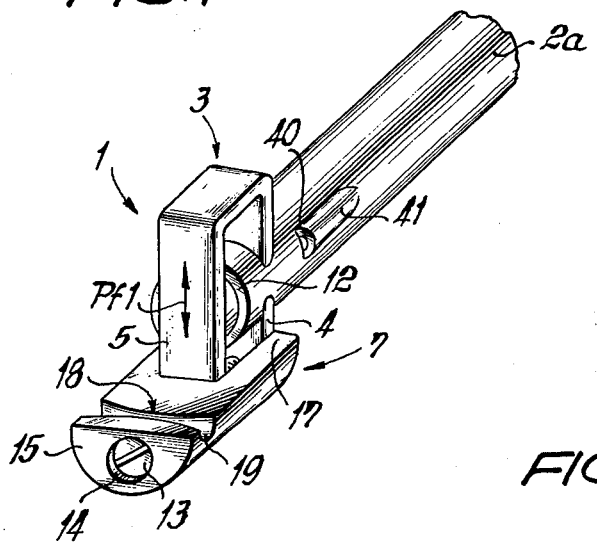
FIG. 1 is a perspective view of a holding and adjusting assembly attached to the free end of a wall fitting.
Figure 3:
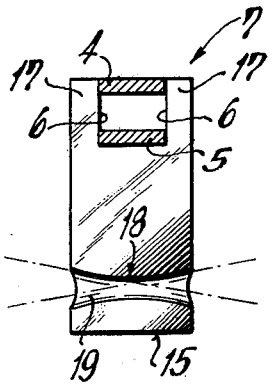
FIG. 3 is a top plan view of FIG. 2.

Referring to FIG. 1 there is provided an adjustable fixing assembly generally indicated by reference number 1 and comprising a wall fitting for anchoring the same to the wall. In the illustrated embodiment this is a tubular knock-in type bracket arm 2*a*. 3 is a substantially U-shaped hairpin type clip of which the inner shank 4 can be pushed into a transverse slot 11 through the tubular bracket arm 2*a*. The outer shank 5 of the clip 3 which faces away from the wall passes across the end face 12 of the tubular bracket arm 2*a*. By pulling together the ends of the shanks 4 and 5 (as will be readily understood from FIGS. 4 and 6), the clip 3 and a holder 7 which it carries can be reliably locked to the end of the knock-in type bracket arm 2*a*. The latter is anchored in the wall in such a way that the transverse slot 11 is in position to receive the clip 3 as indicated by an arrow PF 1 in FIG. 1. Preferably the transverse slot 11 forms a slideway for the inner shank 4 of the clip 3.

Figure 4:
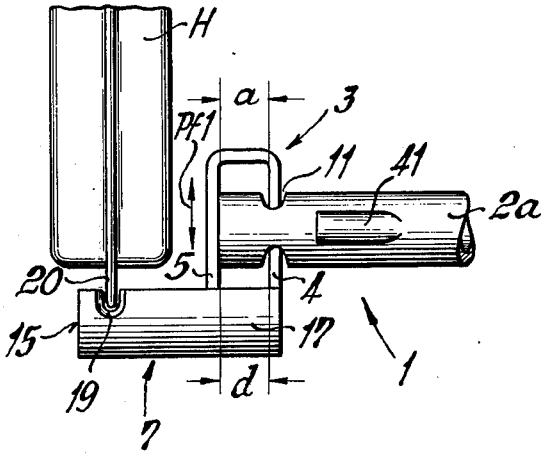
FIG. 4 is a side elevational view of FIG. 1, showing part of a plate type radiator in position.

The distance *a* of the transverse slot 11 from the end face 12 of the knock-in type bracket arm 2*a* corresponds to the clearance *d* between the shanks 4 and 5 of the clip (FIG. 4).

In the embodiment illustrated in FIGS. 1 to 4 the holder 7 is an integral plastics moulding in the form of a substantially U-shaped member with its head under a radiator H. The inner surfaces 6 of the sides 17 of the "U" embrace the sides of the shanks 4 and 5 of the clip 3. Generally these surfaces 6 will be flat and bear flush against the sides of the shanks 4 and 5 of the clip to ensure that the holder 7 cannot turn in relation to the clip 3 though permitting the shanks 4 and 5 to be clamped together for securing the clip.

Figure 2:
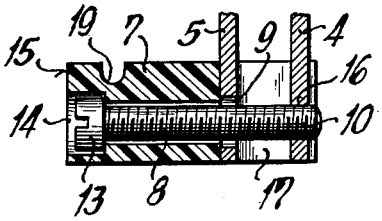
FIG. 2 is a partial side view of the arrangement in FIG. 1 in longitudinal section.
Figure 15:
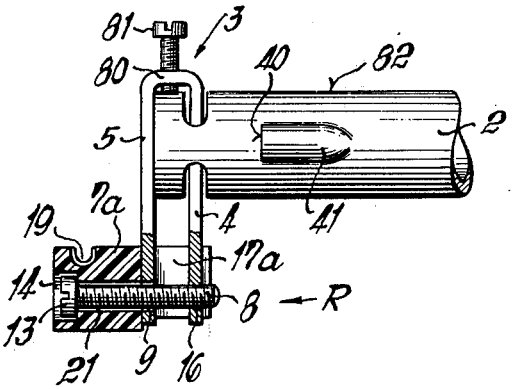
FIG. 15 is a part sectional side elevation of the arrangement in FIG. 14.
Figure 16:
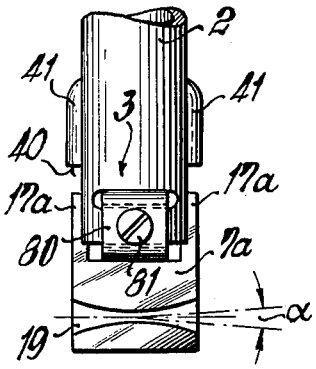
FIG. 16 is a top plan view of the arrangement in FIGS. 14 and 15.
Figure 17:
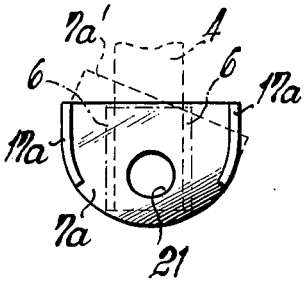
FIG. 17 is a view of the holder from the rear, in the direction marked R in FIG. 15.
Figure 18:
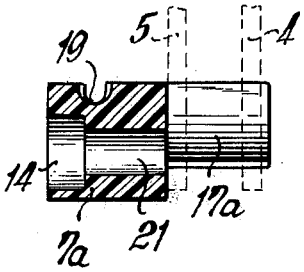
FIG. 18 is a part sectional side view of the embodiment in FIG. 17.

The clamping means is a screw 8 which works in a threaded hole 16 in the inner shank 4 of the clip 3 which passes through the transverse slot 11. The outer shank 5 is likewise provided with a hole 9 but this has no threads and simply serves as an opening for the passage therethrough of the shaft 10 of the clamping screw 8. The hole 9 may also assist in supporting the clamping screw 8. The outer end face 15 of the holder 7 contains a countersink 14 for the reception of the head 13 of the clamping screw 8. The reference numeral 21 denotes a bore through the head of the holder 7 (FIGS. 2 and 15). The countersink 14 is of sufficient depth to afford location to the blade of a screw-driver when pulling the clamping screw 8 tight. The clamping screw 8 forces the holder 7 against the outer shank 5 of the clip 3 and thus clamps the clip 3 tightly in position.

In a conventional manner the holder 7 has a transverse groove 19 which is adapted to receive the flange of a radiator H or the projecting weld seam 20 of a radiator fin. According to an advantageous feature of the invention the transverse groove 19 is narrower in the center 18 than at either end so that the weld seam 20 of the radiator H must be pushed into place with the application of a slight pressure. This ensures a safe and rattle-free fixation which eliminates the possibility of undesirable noise.

Figure 5:
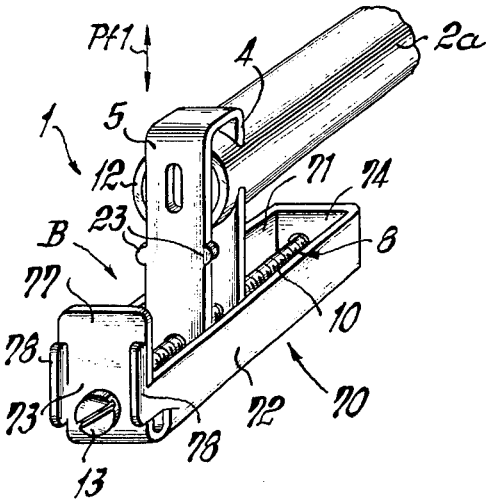
FIG. 5 is a perspective view of an arrangement similar to that in FIG. 1, comprising a holder which functions as the movable jaw of a clamp.
Figure 6:
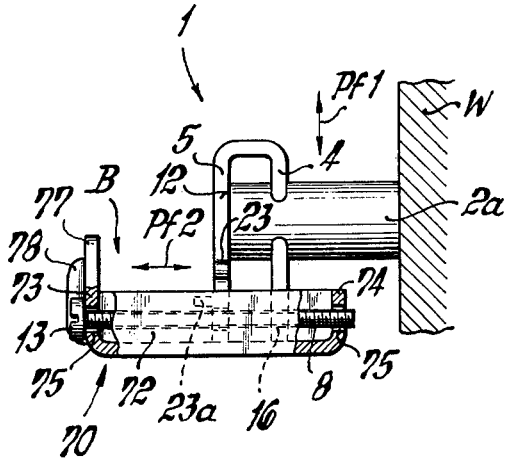
FIG. 6 is a side elevation of an arrangement similar to that in FIG. 5.

FIGS. 5 and 6 illustrate an embodiment of the fixing assembly 1 which differs from the previous arrangement primarily in the construction of the holder, here identified by the reference numeral 70. The holder is here a rectangular sheet metal member of channel section with a closed bottom and sides. The longitudinal side walls are marked 71 and 72 and the end walls 73 and 74. The end walls 73 and 74 are provided with holes 75 for the shaft 10 of the clamping screw 8.

The outer shank 5 of the clip 3 facing the end face 12 of the knock-in type bracket arm 2*a* (FIG. 5) is formed with two enlargements 23 projecting beyond the sides of the transverse slot 11. In FIG. 6 a corresponding projection 23*a* will be seen. Both these elements 23 and 23*a* serve as blocking elements. The outer shank 5 of the clip cannot thus be erroneously pushed through the transverse slot 11 instead of the inner shank 4 which is provided with the threaded hole 16.

According to a useful further development the holder 70 is designed to form the movable jaw of a clamp B for gripping the radiator H or like fitting. For this purpose the outer end wall 73 rises a suitable distance above the side walls 71 and 72 of the holder 70 to form a gripping member 77, as is shown in FIG. 6. The gripping member 77 thus formed clamps the radiator H between itself and the outer shank 5, as will yet be described with reference to FIGS. 7 to 10. By turning the screw 8 the gripping member 70 can be moved in a manner resembling the corresponding action in FIGS. 1 to 4 (cf. the two-headed arrow PF 2 in FIG. 6).

Figure 11:
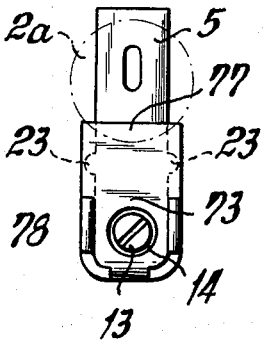
FIG. 11 is a front view of a holder and clip according to FIGS. 5 and 6, the outline of the wall fitting being indicated schematically by dash-and-dot lines.
Figure 12:
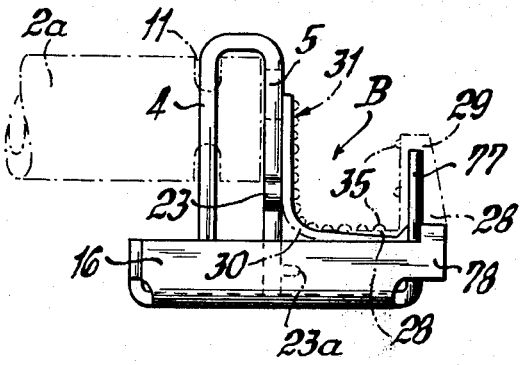
FIG. 12 is a side elevation of the holder and clip of FIG. 11, the arrangement according to the invention in FIGS. 7 to 12 being shown unduly enlarged in relation to the radiator.

In FIGS. 5 to 6 and 12 it will be seen that the gripping member 77 is backed on its outside face by hook-shaped extensions 78 which support it. The clamping forces when the jaw mouth is closed can thus be better taken up by the more elevated gripping member 77 of the end wall 73. These extensions 78 form part of the longitudinal side walls 71 and 72 of the holder 70. At the same time the extensions 78 may be suitably located in relation to the position of the screw head 13 to provide support for a screwdriver, as will be readily understood by reference to FIGS. 5, 11 and 12.

More particularly FIG. 12 illustrates an important development of the invention. In this latter embodiment the jaw mouth, particularly the insides of the members forming the mouth are provided with an insulating lining generally indicated at 28. This comprises substantially a portion 29 which can be fitted over the gripping member 77 and consists of a fairly stiff plastics material, and a further plastics strip 30 which is integral with the portion 29 and bears against the insides of the jaw mouth formed by the holder 70 and the outside of the outer shank 5 of the clip.

This plastics strip 30 and possibly the plastics portion 29 may be provided with transverse ribbing 35 to improve its elasticity. The reference numeral 31 denotes the free end of the plastics strip 30.

Figure 13:
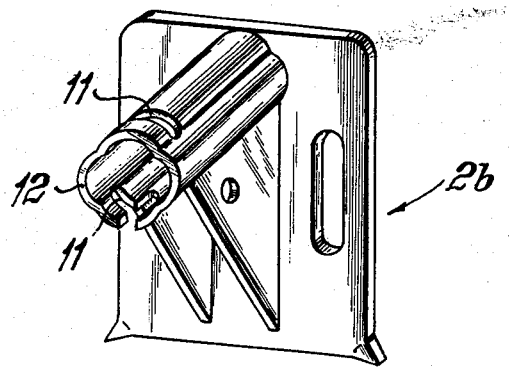
FIG. 13 is a perspective view of a surface-mounting wall fitting.

FIG. 13 shows a tubular wall fitting 2*b* which is intended to be fitted to the surface of a wall. Analogously to the tubular knock-in type wall fitting 2*a* the transverse slot 11 for the insertion of the clip passes through the tube and is designed to receive the inner shank 4 of the clip 3. So far as the clip 3 is concerned this is the same whether the wall fitting is intended to be knocked into a wall, such as 2*a*, or to be secured on the plaster surface, such as 2*b*. This member will therefore hereinafter simply be referred to as the "wall fitting 2".

Figure 7:
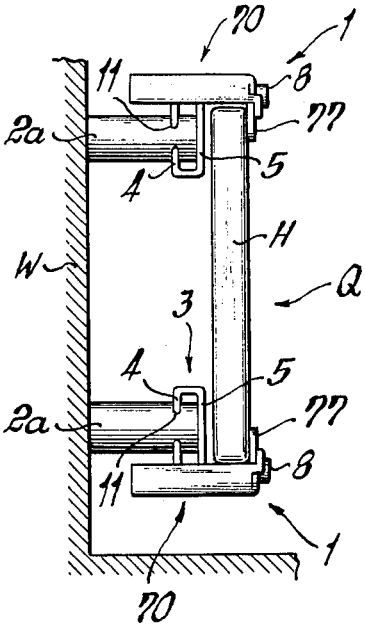
FIG. 7 is a side elevation of a plate-type radiator held at the top and the bottom by fixing devices according to FIGS. 5 and 6.
Figure 8:
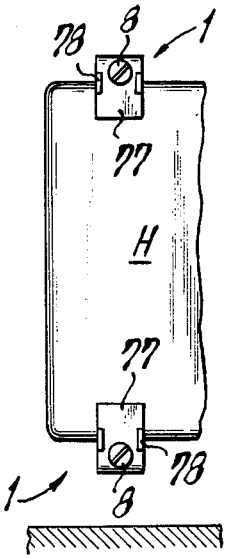
FIG. 8 is a partial front view of a radiator and the fixing means in FIG. 7.

FIGS. 7 to 10 schematically illustrate the manner in which a radiator H is supported by fixing means as proposed by the invention. The wall fitting may be of the knock-in or surface-mounting type 2*a* or 2*b*. In FIGS. 7 and 8 a clip 3 has been inserted into the transverse slot 11 of the lower wall fitting 2. The outer shank 5 at first bears loosely against the end face 12 of the wall fitting 2. Since the clamping screw 8 passes through the outer shank 5 without much clearance but also without threadedly engaging the same and works in the threaded hole 16 of the inner shank 4, the screw 8 will at first pull the holder 70 and its gripping member 77 towards the radiator H until the latter is forced up against the outer shank 5. The screw can then be pulled tight when it will cause the two shanks 4 and 5 to be pulled together, fixing the clip 3 and the holder 70 on the wall fitting.

Figure 9:
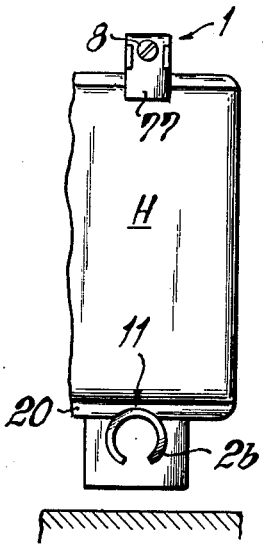
FIG. 9 is a front view of the radiator according to FIG. 8, supported from underneath by the wall fitting and located at the top by an adjustable holder.
Figure 10:
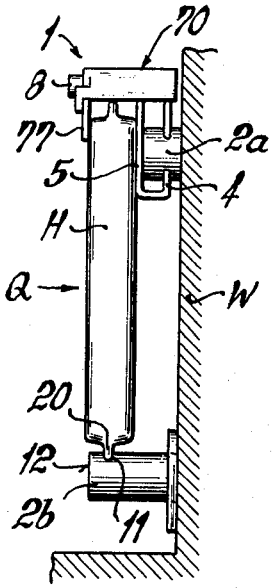
FIG. 10 is a side view of the arrangement in FIG. 9.

The fixing assembly 1 for the top of the radiator H is mounted upside down, i.e. the jaw mouth grips the radiator H from above. FIGS. 9 and 10 illustrate the fixation of a radiator H using holders 70. For supporting the radiator H at the bottom merely a wall fitting bracket arm 2*b* of the surface-mounting type has been provided. The projecting weld seam 20 of the radiator is received into the upper end of the transverse slot 11. However, the top of the radiator is located by a fixing assembly 1 in the manner that has been described, with the aid of clamps B formed by holders 70. This simplified form of fixation by the fixing assemblies 1 is quite possible, particularly if the wall fittings 2 at the bottom of the radiator H are secured to a wall W with appropriate accuracy. Any production tolerances and errors when fitting can be easily compensated by the holders 70 at the top of the radiator. Even if a radiator H according to FIGS. 7 to 10 is to be fitted in a niche, below a window sill or the like, fixing assemblies 1 as proposed by the invention permit the radiator to be easily mounted because the important fitting operations and manipulations can be performed in the direction marked Q in FIGS. 7 and 10. More particularly readjustment and final location of the radiator H can be easily accomplished from the face side of the radiator when an assembly 1 according to the invention is used.

Figure 14:
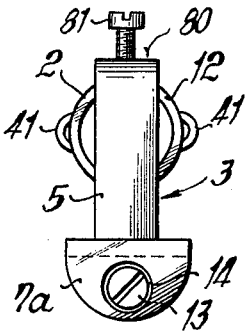
FIG. 14 is a front elevational view of a slightly modified form of construction of the arrangement shown in FIGS. 1 to 4.

A slightly modified form of construction of the embodiment of the holder illustrated in FIGS. 1 to 4 in the form of an integral plastics moulding is shown in FIGS. 14 to 19, and its employment will now be described. FIG. 14 shows a holder 7*a*, an associated clip 3 and a wall fitting 2. The major difference will be readily seen from an inspection of FIG. 17. The sides 17*a* have no guiding function and lack inner surfaces 6 as provided in the embodiment according to FIGS. 1 to 4 and as indicated again in dash-and-dot lines for the sake of comparison. Instead, the sides 17*a* of the holder 7*a* are spaced outwardly away from the shanks of the clip so that the holder 7*a* can be tilted about the longitudinal axis of the screw in the manner indicated in FIGS. 17 by 7*a*'.

Figure 19:
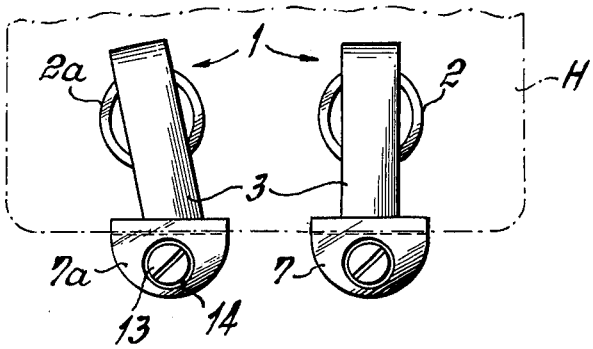
FIG. 19 is a front elevation of two arrangements of the kind shown in FIGS. 14 to 18 in which the wall fittings have been anchored in the wall at different levels and the difference is compensated by tilting the clip and the holder accordingly.
Figure 20:
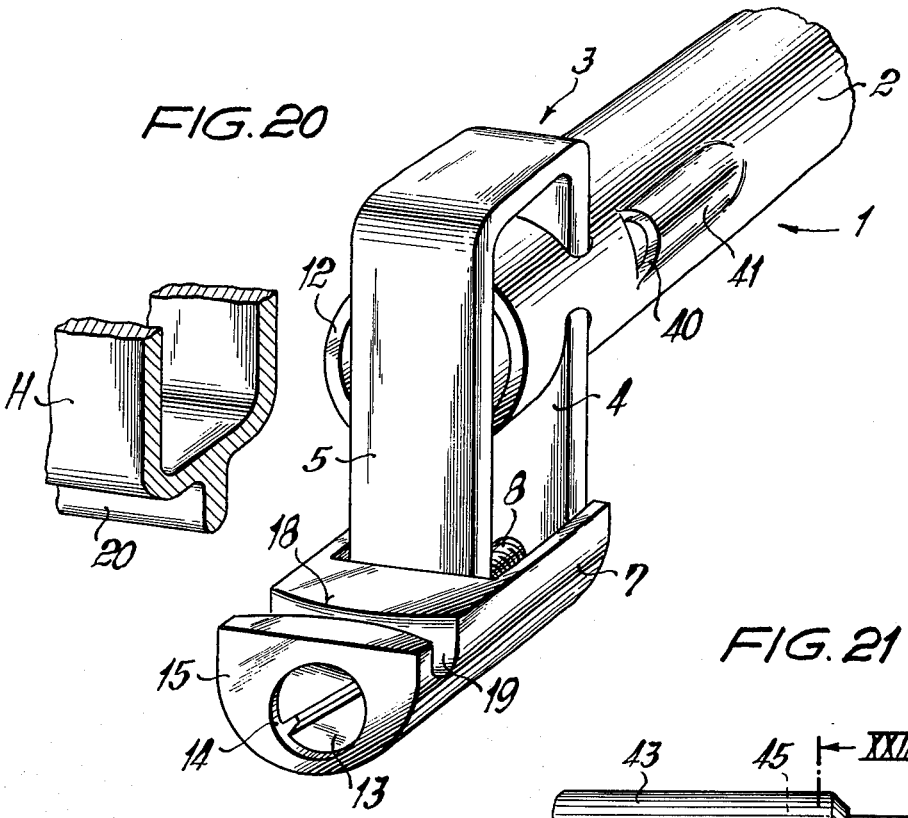
FIG. 20 is a perspective view, on a much larger scale, of the embodiment according to FIGS. 14 to 18.

FIG. 19 exemplifies the effect of this feature. If it is impossible to secure two wall fittings 2 associated with the same radiator to a wall in such a way that they are level and/or in the same position with regard to the direction of the slot, then a fixing assembly 1 which comprises a tiltable holder 7*a* can be used to mount the radiator H in the manner indicated by dash-and-dot lines in the drawings. If necessary, for example assuming that a wall fitting should accidentally have been placed too low, the knock-in type tubular fitting 2*a* can be deliberately slightly turned as shown in the left-hand drawing of FIG. 19. The holder 7*a* will thus be slightly lifted and the radiator H can be kept horizontal. In FIG. 20 the described assembly 1 and a portion of the radiator H are shown once again.

FIGS. 1, 20 and particularly 21, 22 and 24 show abutments 40 on the knock-in type wall fitting 2*a*. These abutments have the form of two bulb-like bosses 41 which project from each side. The abutments 40 are intended to provide surfaces to which a driving sett, generally marked 42, can be applied (FIGS. 21 to 24). This has a socket 44 recessed into its head 43 and adapted to receive the outer end of the knock-in fitting 2*a*. According to another feature of the invention the abutments 40 on the wall fitting 2 are set back from the slot 11 towards the wall W sufficiently to ensure that any deformation of the wall fitting 2 experienced whilst it is being driven into the wall will not involve the portion containing the slot 11. This is important because the outer end of the wall fitting containing the end face 12 and the slot 11 are designed to fit the clip 3, so that the desired fit might well be lost if the wall fitting were slightly out of shape. Yet another feature consists in providing the head of the driving sett 42 with recesses 45 which are adapted to receive part of the length of the bulbous abutments 41. These recesses 45 are so designed that they tightly embrace the abutments 41 in such a way that the wall fitting 2*a* and the driving sett 42 can be easily fitted together and the cooperation of the abutments 41 with the recesses 45 prevents relative rotation. This has the advantage that when driving the wall fitting 2*a* into the wall its position can be controlled and possibly corrected with the help of the driving sett. In case of need the driving sett 42 can also be used to turn the fitting 2*a* about its longitudinal axis. Moreover, according to yet another feature of the invention the driving sett 42 also contains a plurality of abutments 46 and 47. One pair of abutments 46 is at the bottom of the recesses 45 and they cooperate with the end faces 40 of the bulbous bosses 41. A second pair of abutments 47 is intended to cooperate with the end face 12 of the fitting 2*a*, more particularly in such a way that these latter abutments 47 will not make contact with the end face 12 of the fitting until the abutment faces 40 have been slightly upset by the first few blows of the hammer. It has been found that this permits the impact forces to be very satisfactorily applied to a knock-in type wall fitting without causing significant deformation of the forward end which is fitted with the clip 3.

Figure 21:
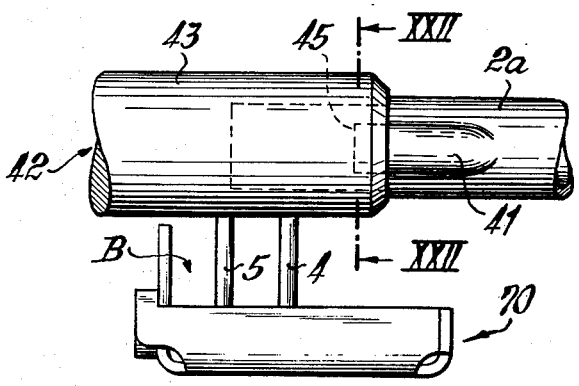
FIG. 21 is a side view of the outer end of a knock-in type wall fitting provided with a clip and holder and about to be driven into the wall with the aid of a suitably contrived driving sett.

Another feature of the invention consists in making the clip 3 narrower than the cross section of the end face 12, and more particularly than the abutment face 40 on the knock-in wall fitting 2*a*. If this is done the driving sett can be pushed over the outer end of the provisionally fixed fitting 2*a* after this has already been provided with a clip 3 and a holder 7, and the fitting can thus be knocked into position together with these parts (FIG. 21).

Figure 24:
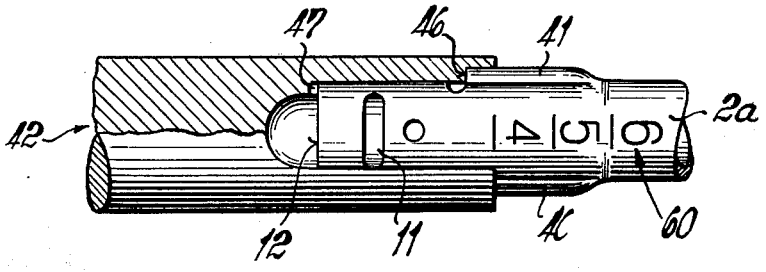
FIG. 24 is a part sectional view of the driving sett engaging a knock-in type wall fitting.

According to a further development of the invention the knock-in wall fitting 2*a* may bear impressed gauge marks 60 indicating the depth of insertion, as shown clearly in FIG. 24. This is a useful aid when knocking the fitting into a wall.

Figure 25:
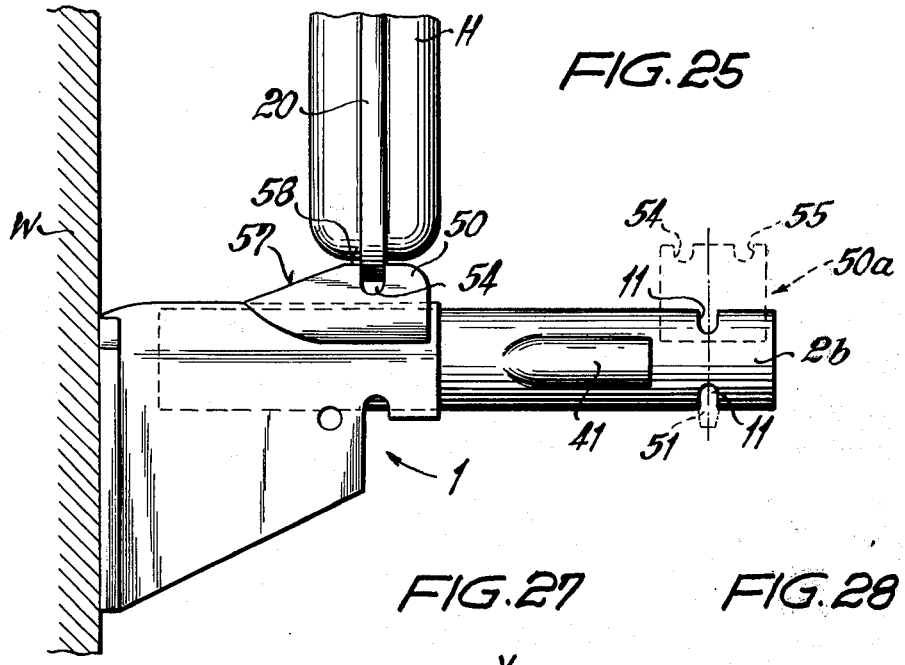
FIG. 25 is a side view of surface-mounting wall fitting provided with two damping elements.
Figure 27:
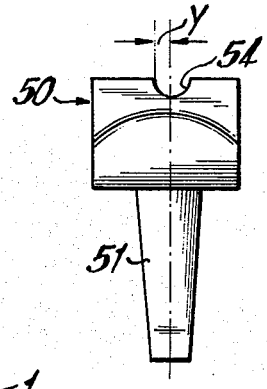
FIG. 27 is a side view of a damping element.
Figure 28:
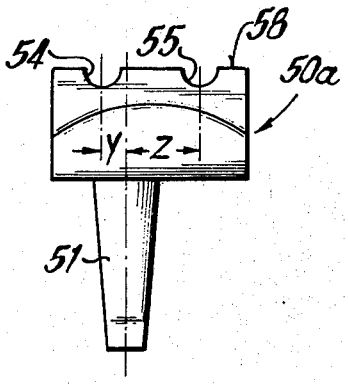
FIG. 28 is a slightly modified damping element.
Figure 26:
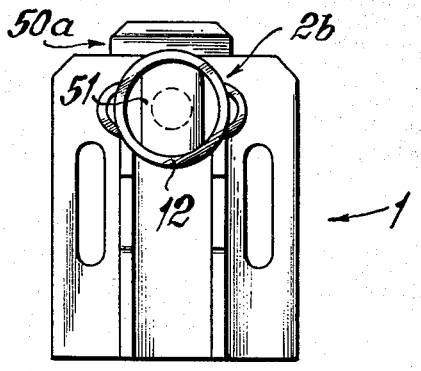
FIG. 26 is an end-on view of the wall fitting in FIG. 25.

Furthermore, a damping element 50 with a holding tab 51 to fit the transverse slot 11 may be provided for both knock-in and surface-mounting fittings 2*a*, 2*b*. The tab 51 may preferably be arranged to be a wedge fit in the slot 11. A preferred arrangement is shown in FIGS. 25 and 28. Damping element 50*a* contains two locating grooves 54 and 55 asymmetrically placed with reference to the tab 51. However, if desired, and as shown in the embodiment of the damping element 50 in FIG. 27, a single locating groove may be slightly offset from the center line of the tab, for instance by an amount Y in FIG. 27. In FIG. 28 different amounts of offset Y and Z of the two grooves are shown. Such an arrangement permits the position of the bottom edge of a radiator to be adjusted according to the position of the fixing assembly 1 at the upper edge of the radiator H. In case of need the damping element 50 is also suitable for compensating differences in elevation. Generally speaking, the element provides a noise-suppressing thermal insulation, particularly when for instance the bottom edge of the radiator is not held by elevationally adjustable elements but merely by the wall fittings 2 themselves (FIGS. 9 and 10).

A set of fixing elements comprises several fixing assemblies 1, possibly including holders 7, *7a,* 70 of varying forms of construction as well as damping elements 50 for insertion into the transverse slots 11 of the wall fittings (cf. FIGS. 25 to 28 in conjunction with FIGS. 9 and 10). Moreover, in addition to its sound and heat insulating functions the damping element 50 is also capable of compensating differences in level in a radiator H, so that the latter can be more securely embraced by clamping jaws embracing for instance its upper end. In this respect the damping element 50 may also serve to enable fixing assemblies 1 for holding the radiator to be positionally better related. Moreover, a set of fixing elements may also include the other above-described elements, particularly a driving sett 42.

According to another feature of the invention the end face 12 of the wall fitting 2 may substantially be an annular face, as shown for instance in FIGS. 1, 5 and 11 to 14. In such a case the member forming the knock-in or surface-mounting type of wall fitting bracket arm 2*a,* 2*b* may be tubular and simple, apart from the fact that tests have shown that a safe and non-slip connection will form between an annular face 12 and a clip 3 when this is pulled tight.

Figure 22:
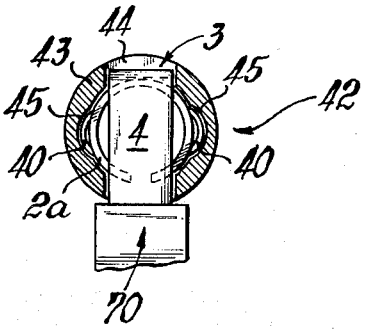
FIG. 22 is a cross section on the line XXII — XXII of FIG. 21.
Figure 23:
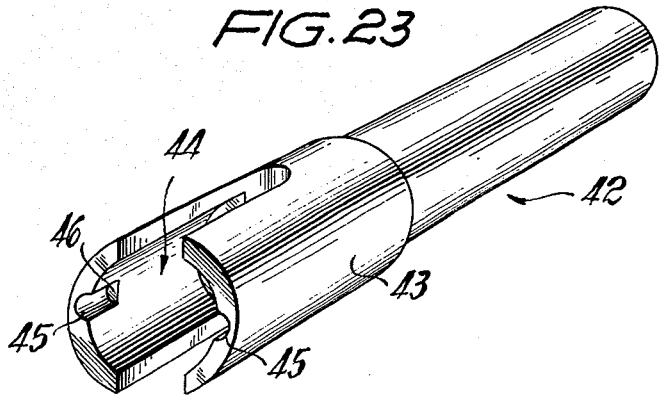
FIG. 23 is a schematic perspective view of the end of a driving sett which is applied to the wall fitting.

Furthermore, a useful further optional feature of the driving sett 42 is to contrive the socket 44 for the reception of the knock-in wall fitting 2*a* or the like, in the form of a slot completely traversing the end of the sett (cf. FIGS. 22 and 23). This is desirable for driving home the wall fittings 2*a* after these have been provided at least with the clip 3. This slot-shaped opening provides the necessary space, as will be understood from FIG. 22.

The proposed set of fixing elements enables principally radiators H as well as other comparable installational units to be conveniently attached to a wall within a short space of time, and also tolerational differences which arise when the wall bracket arms are fixed and other differences and manufacturing tolerances of the radiator itself to be readily compensated. It is an important feature of the arrangement that in numerous cases where this is highly desirable the radiator can be securely clamped in position by the tightening of only one single clamping screw in respect of each fitting and that this can be done from the front (cf. arrow Q) of the radiator H. Moreover, in a desirable manner different single elements of the set can be used in different fixing assemblies. The matching correspondence of the parts of the set, particularly of the knock-in type wall fitting 2*a* and the driving sett, further considerably facilitates the mounting operation.

FIG. 25 discloses yet another optional feature of the invention. As a further assembly aid the damping element 50 is formed with a ramp 57 for lifting the radiator into position. For this purpose the top 58 of the damping element 50 has an extension normal to the direction of the locating groove 54 or 55 so that the resultant inclined surface of the ramp extends to the top of the, say tubular, bracket arm of a surface-mounting wall fitting 2*b,* as is clearly shown in FIG. 25. The radiator H can then first be deposited on the top of the arm of the surface-mounting wall fitting 2*b* near the wall W. A damping element 50 formed with the described ramp can then be fitted by inserting its tab into the slot 11 so that the ramp faces the radiator H and the damping element is firmly located on the arm 2*a* or 2*b.* The same can be done in the case of several wall fittings 2 which are intended to carry the radiator H. Finally the radiator can be pulled forward towards the groove 54 or 55. The radiator will then fairly easily ride up the ramp 57 to the top 58 of the damping element where its weld seam 20 or the like will drop into the required groove 54 or 55. The damping element 50 thus constitutes an additional fitting aid. It not only permits the elevational position of radiators H to be corrected, but the ramp 57 also assists when a heavy radiator must be lifted into position.

Finally, the reference may again be made to FIG. 15 which discloses the provision of a fixing screw 81 in the U-bend 80 of the clip 3. The screw works in a threaded hole (not shown) in the U-bend 80, whereas its end rests on the top 82 of the wall fitting 2, and thus provides for elevational adjustment. This arrangement is particularly useful when the clips 3 are intended to carry heavy components, especially when the shanks 4 and 5 of the clips need be rather long. It is then possible for the clamping thrust applied by the clamping screw 8 to the shanks 4 and 5 to be insufficient to retain the clip 3 at the desired elevational level. As stated, this may be the case when the entire weight of larger sized and consequently heavy radiators H must be borne by only one or two holders 7, *7a* or 70. The screw 81 will then provide an additional mechanical and positive locating means for height to maintain the desired position of the clip 3. This additional aid does not in any way complicate the process of mounting. The screws 80 need be inserted only when the clips 3 at the bottom of heavy radiators H are called upon to carry considerable loads. The screws can be fitted before the radiators are lifted into place when the clips 3 are still easily accessible. A sufficient number of clips 3 are then adjusted to the required height using a spirit level (cf. e.g. FIG. 19) and held in this position by the screws 81. After the radiator H has been mounted additional fixing assemblies 1 not provided with a screw 81 can be used for locating the radiator H.

The invention may be embodied in other specific forms without departing from the spirit or essential characteristics thereof. The embodiments are therefore to be considered in all respects as illustrative and not restrictive.

What is claimed is:

1. A set of fixing elements for mounting structures, particularly radiators, on a support such as a wall, comprising an elongated wall fitting adapted to be mounted on a support, the wall fitting having a transverse slot at its end projecting outwardly of the support; a U-shaped clip having a first shank slidably mounted in the transverse slot and a second shank said clip being deformable so as to move said second shank against the end of said fitting; a holder adapted to support a structure and being connected with the clip so as to move with the latter and thereby adjust the position of the holder relative to the wall fitting; and clamping means for drawing the shanks towards each other and for clamping the second shank against the projecting end of the wall fitting so as to securely fix the holder to the wall fitting.

2. A set of fixing elements as defined in claim 1, wherein the holder forms the movable jaw of a clamp having a mouth of adjustable width for transversely gripping the radiator.

3. A set of fixing elements as defined in claim 1, wherein the holder is an upwardly open trough-shaped member having a bottom and side and end walls, the two end walls containing holes for a clamping screw.

4. A set of fixing elements as defined in claim 3, wherein an extension on one end wall of the holder forms a gripping member of the jaw which is movable towards the outer shank of the clip.

5. A set of fixing elements as defined in claim 4, wherein part of the movable jaw is backed on the outside by hook-shaped extensions of the side walls of the trough-shaped holder.

6. A set of fixing elements as defined in claim 5, wherein part of the hook-shaped extensions is designed to serve as a guide means for locating the working end of a screwdriver blade.

7. A set of fixing elements as defined in claim 4, wherein at least the inside of the gripping member of the jaw facing the radiator is provided with an insulating lining.

8. A set of fixing elements as defined in claim 7, wherein the insulating lining comprises a portion which consists of a stiff plastics material and which is a wedge fit on the gripping member of the jaw, said portion being integral with a strip of elastic plastics material lining the mouth of the jaw and the outer shank of the clip.

9. A set of fixing elements for mounting structures, particularly radiators, on a support such as a wall, comprising a holder adapted to support a structure; a wall fitting associated with the holder and having a transverse slot at its end projecting outwardly of a support; a hair-pin type U-clip connected with the holder and having a slightly resilient inner shank and a substantially parallel slightly resilient outer shank, the width of the transverse slot in the projecting end of the wall fitting being of a width dimensioned to receive, guide and locate one of the shanks of the clip, so that the position of the holder can be adjusted relative to the wall fitting, the two shanks being separated by a distance equal to the distance of the transverse slot relative to the end face of the projecting end of the wall fitting; and means for clamping the outer shank against the projecting end of the wall fitting so as to fix the clip in position relative to the wall fitting.

10. A set of fixing elements as defined in claim 9, wherein the inner shank of the clip which is nearest the wall is provided with a threaded hole for engaging the threads of a clamping screw which passes through a bore in the holder as well as through a plain hole in the outer shank of the clip, the head of the screw being adapted to pull the holder against the outer shank of the clip which is remote from the wall.

11. A set of fixing elements as defined in claim 10, comprising a trough section holder having a bottom and side and end walls, and a clamping screw whose shaft extends through the length of the holder and is rotatably mounted in holes in the end walls of the trough but threadedly engages the shank of the clip which is nearest the wall.

12. A set of fixing elements as defined in claim 10, wherein the end face of the holder facing away from the wall is formed with a countersink for the reception of the head of the clamping screw and for guiding and locating the blade of a screwdriver used for driving the screw.

13. A set of fixing elements as defined in claim 10, wherein the head of the clamping screw bears against the outer end face of the holder which functions as a sliding member between the head of the screw and the outer shank of the clip.

14. A set of fixing elements as defined in claim 9, wherein the outer shank of the clip bears against the outer end face of the wall fitting and is provided with a lateral enlargement exceeding the width of the transverse slot provided in the wall fitting for the reception of said one of the shanks of the clip.

15. A set of fixing elements as defined in claim 9, wherein said holder is a substantially U-shaped member, the head of the U being placed towards the radiator and the two sides of the U embracing the sides of the shanks of the clip.

16. A set of fixing elements as defined in claim 15, wherein the sides of the holder which embrace the sides of the shanks of the clip are laterally spaced away from the shanks of the clip to enable the holder to be tilted about its longitudinal axis.

17. A set of fixing elements for mounting radiators or like bodies on walls comprising a wall fitting associated with an integrally plastically molded holder for a radiator or like body, the holder being attachable to the wall fitting by a connector in the form of a clip which can be adjustably attached to the wall fitting and clamped in position, the wall fitting being traversed at its freely projecting end by a slot for the reception of part of said clip.

18. A set of fixing elements for mounting structures, particularly radiators, on a support such as a wall, comprising a holder adapted to support a structure; a knock-in type wall fitting associated with the holder and formed as a bracket arm and having a transverse slot at its end projecting outwardly of the support, the projecting end having outwardly-extending radially-projecting abutments having abutment faces adapted to be engaged by a driving sett tool; a clip connected with the holder and having a portion slidably received in the transverse slot so that the position of the holder can be adjusted relative to the wall fitting, the abutments extending outwardly apart a greater distance than the transverse width of the clip; and means for clamping the clip in position against the wall fitting.

19. A set of fixing elements as defined in claim 18, wherein said abutment faces are set back from the free end face of the wall fitting towards the surface of the wall.

20. A set of fixing elements as defined in claim 18, wherein the abutment faces on the wall fitting are formed by the ends of bulbous elevations spaced laterally further apart than corresponds to the width of the clip and possibly also of the holder and set further back from the end face of the wall fitting than the transverse slot for the reception of one shank of the clip, whereas the driving sett is provided with a corresponding axial recess which forms abutment faces at its inner end so contrived that the driving sett when applied to the wall fitting closely embraces and fits over the bulbous elevations.

21. A set of fixing elements as defined in claim 18, wherein the driving sett contains a first and a second pair of abutment faces at axially different distances from the end of the sett which is applied to the fitting, said abutment faces cooperating with abutments on the knock-in type wall fitting in such a way that the second pair of abutment faces will not yet be operative when the first pair of abutment faces is already in contact, the second pair being designed to make contact when the first pair is already slightly deformed.

22. A set of fixing elements as defined in claim 20, wherein the recess in the driving sett extends radially to the periphery of the sett in the form of a slot on one and possibly both sides.

23. A set of fixing elements as defined in claim 18, wherein the knock-in type bracket arm bears impressed markings indicating the depth of penetration into the wall.

24. A set of fixing elements as defined in claim 18, comprising a damping element which can be mounted on a knock-in or a surface-mounting type wall fitting, said damping element having a tab adapted to wedge into the transverse slot otherwise intended for the reception of the clip.

25. A set of fixing elements as defined in claim 24, wherein the damping element is provided with at least one groove offset from the median center plane of the tab, the distance of offset of each groove being preferably different.

26. A set of fixing elements as defined in claim 25, wherein the damping element is formed with a ramp extending perpendicularly to the groove and rising from the top of the wall fitting to the top of the damping element.

27. A set of fixing elements for mounting radiators or like bodies on walls, comprising a wall fitting associated with a holder for a radiator or like body, the holder being attachable to the wall fitting by a connector in the form of a clip which can be adjustably attached to the wall fitting and clamped in position, the wall fitting being traversed at its freely projecting end by a slot for the reception of part of said clip, and mechanical support means including a screw in the top of the clip for bearing down on the top of the wall fitting.

* * * * *